US006786743B2

(12) United States Patent
Huang

(10) Patent No.: US 6,786,743 B2
(45) Date of Patent: Sep. 7, 2004

(54) CONNECTING HUB ASSEMBLY HAVING UNIVERSAL JOINT

(76) Inventor: Yea Yen Huang, No. 12, Alley 70, Sec. 1, Chung Hua Road, Tocheng City, Taipei Hsien (TW)

( * ) Notice: Subject to any disclaimer, the term of this patent is extended or adjusted under 35 U.S.C. 154(b) by 9 days.

(21) Appl. No.: 10/314,274

(22) Filed: Dec. 9, 2002

(65) Prior Publication Data

US 2004/0109722 A1 Jun. 10, 2004

(51) Int. Cl.[7] ..... H01R 13/44

(52) U.S. Cl. ..... 439/131; 439/8; 439/528; 439/6; 439/31

(58) Field of Search ..... 439/131, 6, 8, 439/31, 11, 13, 528, 534, 640

(56) References Cited

U.S. PATENT DOCUMENTS 2,652,546 A * 9/1953 Christner ..... 439/8
6,074,253 A * 6/2000 Brinchmann-Hansen .... 439/624
6,290,517 B1 * 9/2001 Anderson ..... 439/131
6,559,383 B1 * 5/2003 Martin ..... 174/84 R

* cited by examiner

*Primary Examiner*—Tho D. Ta
(74) *Attorney, Agent, or Firm*—Troxell Law Office PLLC

(57) ABSTRACT

A connector hub assembly having universal joint comprises a housing including at least a first connector having its mating portion accessible from a surface of the housing. A joint device is universally attached to the housing such that the housing is moveable along a first plane. A second connector is attached to the joint device. The joint device includes a socket defined in a recessed portion of the housing and a ball joint swivelably received in the socket. Wherein the joint device further includes a pin shaft located on an end of supporting arm of the ball joint, wherein the second connector is pivotally mounted on the pin shaft.

13 Claims, 4 Drawing Sheets

CONNECTING HUB ASSEMBLY HAVING UNIVERSAL JOINT

BACKGROUND OF THE INVENTION

1. Field of the Invention

The present invention relates to a connector hub assembly, and more particularly to a connector hub assembly having universal joint thereby providing a robust usage for customer.

2. Description of the Prior Art

With the efforts made many information management engineers, the computer has been continuously improved and upgraded. As such, a great deal of peripheral equipments has been introduced. In addition, as the local area network has become more and more popular, interconnections between peripheral equipments, notebook computers, personal computer (desktop computer), servers become more ad more complicated.

Among the peripheral equipments, printers, scanners, monitors and portable disk drivers have a comparable larger size, while keyboards, mouse, modem, card reader, digital camera, outer box and hub have a comparable smaller size. However, unless each of the above mentioned equipments is electrically connected to the computer, it would not work. Accordingly, how to make such interconnections between the peripheral equipments and the computers and powered them is really an art of work.

The innovation and invention of the Universal Serial Bus (USB), IEEE 1394 connectors, PS2 connectors really improve the interconnection between the computers and the peripheral equipments. Because of the introduction of the above-mentioned connection ports, the peripheral equipments can be readily and easily interconnected to the computer. The customers can easily use those peripheral equipments along with their computers.

The uniqueness and features of the connectors of the USB, IEEE 1394, and PS2 are those connectors generally include totally four conductive wires. Among them, two out of four or four out of six are used for signal transmission, while the rest two conductive wires are used for power transmission. The power transmitted through those two power conductive wires is about 5 voltages and 500 mA. As such, the electrical interconnection between the computer and the peripheral through those connectors can facilitate both signal and power transmission. Furthermore, nowadays, the USB, IEEE 1394, and PS2 connectors have become a standard connector on desktop computer, notebook, and hub. The interconnections between the computers and the peripheral equipments are therefore become more and more convenient and user-friendly.

However, one of the problems when using those connectors is that the mating orientation is fixed. In addition, the dimension of the connector is sometime too large to block the adjacent connecting ports. In order to prevent the shortcoming, an extension cord or adaptor is introduced. While this extension cord or adaptor solve one problem, it has some side effect because it is inconvenient for customers to carry a plurality of adaptors or extension cords.

SUMMARY OF THE INVENTION

An object of this invention is to provide a connector hub assembly in which the mating ports thereon can be readily and conveniently change its orientation so as to provide an easy and convenient connections with respect to different peripheral equipments.

According to one of the aspects of the invention, the connector hub assembly is provided with a universal joint such that the connector hub assembly can be rotated in X, Y and Z direction thereby effectively solving the problem encountered by the prior arts.

In order to achieve the object set forth, the connector hub assembly in accordance with the present invention comprises at least a first connector having its mating portion accessible from a surface of the housing. A joint device is universally attached to the housing such that the housing is moveable along a first plane. A second connector is attached to the joint device. The joint device includes a socket defined in a recessed portion of the housing and a ball joint swivelably received in the socket. Wherein the joint device further includes a pin shaft located on an end of supporting arm of the ball joint, wherein the second connector is pivotally mounted on the pin shaft.

According to another aspect of the present invention, the joint device is a hinge having a hollowed shaft with the second connector rotationally mounted thereto by means of a pin shaft.

Still according to another aspect of the present invention, the joint device is a link interconnected the first and second connectors by means of pin shafts, respectively.

DETAILED DESCRIPTION OF PREFERRED EMBODIMENTS

Figure 1:
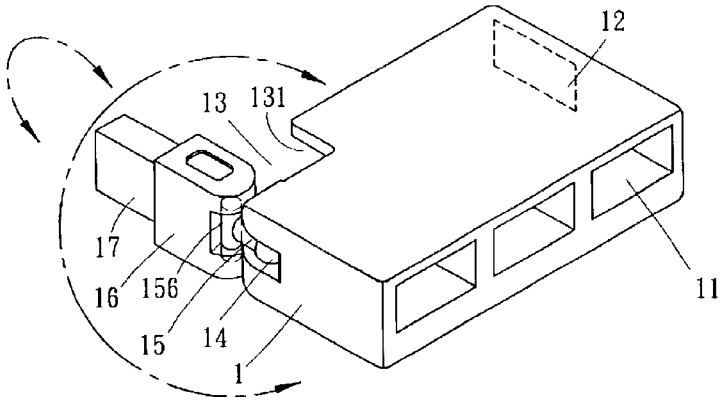
FIG. 1 is a perspective view of a connector hub assembly made in accordance with a first embodiment of the present invention.
Figure 2:
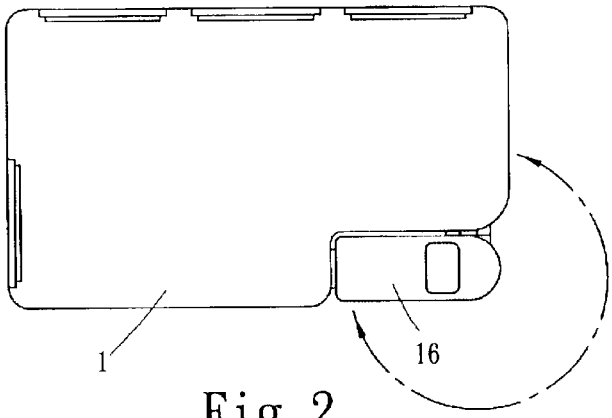
FIG. 2 is a top view of FIG. 1.
Figure 3:
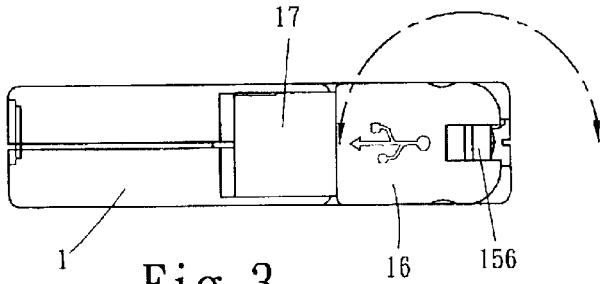
FIG. 3 is a rear view of FIG. 1.
Figure 4:
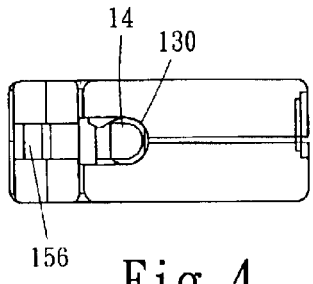
FIG. 4 is an end view taken from left direction of FIG. 1.

Referring to FIGS. 1 to 4, a connector hub assembly 1 in accordance with a first embodiment of the present invention. The connector hub assembly 1 is provided with USB mating ports 11 and 12 located at different surfaces (not labeled). Of course, USB is merely a choice, and which can be readily substituted by IEEE 1394 or other suitable connectors. The connector hub assembly 1 is further provided with a recessed portion 13 in which a socket 130 defined therein. The connector assembly 1 further defines a receiving slot 131 having a stopper 132 therein, which can be readily seen from FIG. 5. A ball joint 14 is pivotally mounted within the socket 130.

Figure 5:
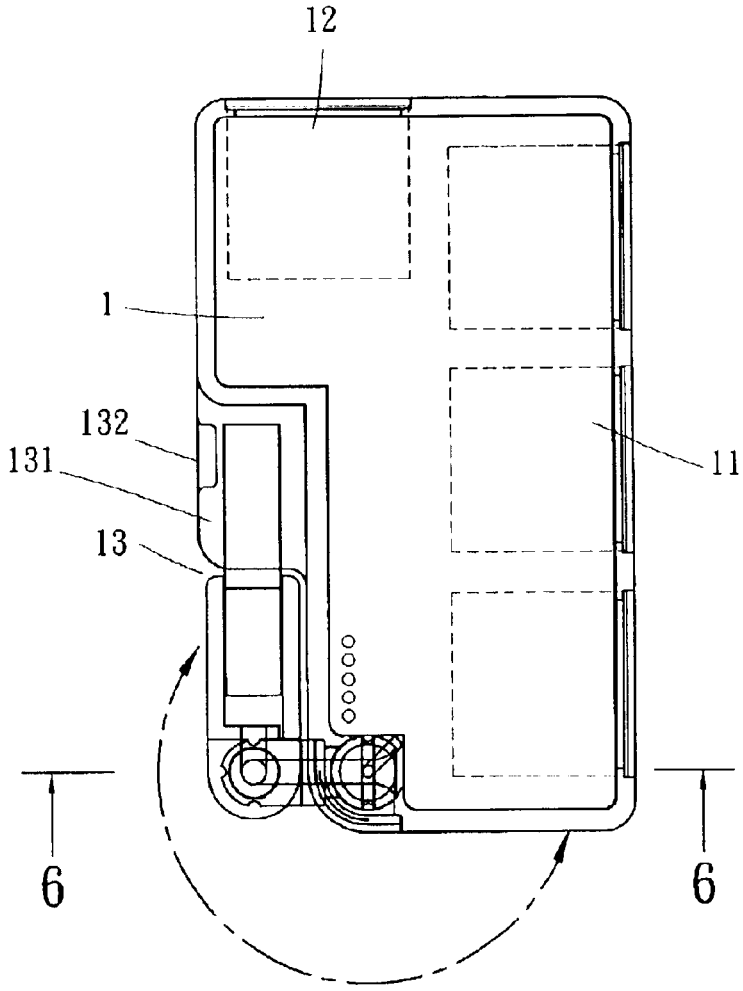
FIG. 5 is similar to FIG. 2, while showing internal connectors with dotted lines.
Figure 6:
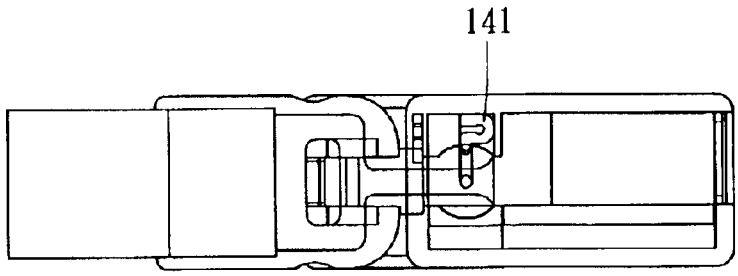
FIG. 6 is a cross sectional view taken from lines 6—6 of FIG. 5.
Figure 7:
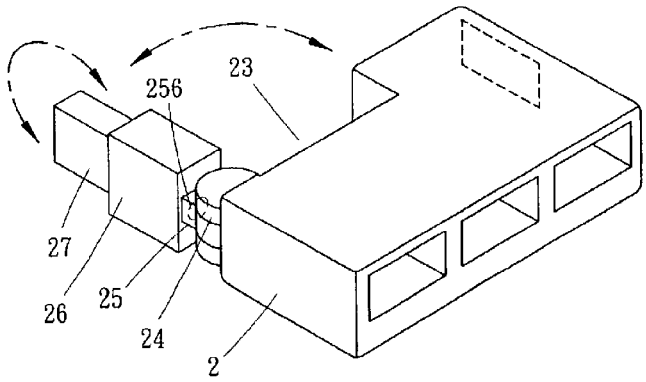
FIG. 7 is a perspective view of a connector hub assembly made in accordance with a second embodiment of the present invention.
Figure 8:
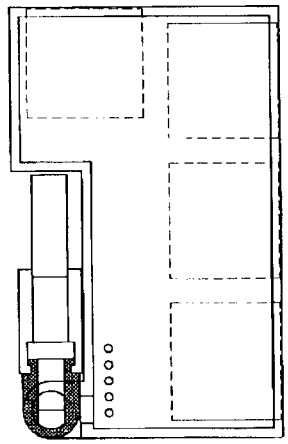
FIG. 8 is a top view of FIG. 7.
Figure 9:
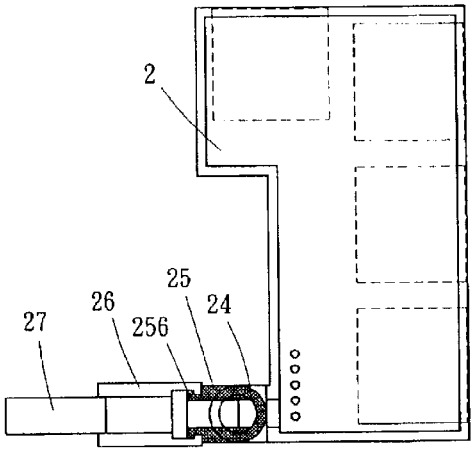
FIG. 9 is similar to FIG. 8 with a second connector arranged in a first position.
Figure 11:
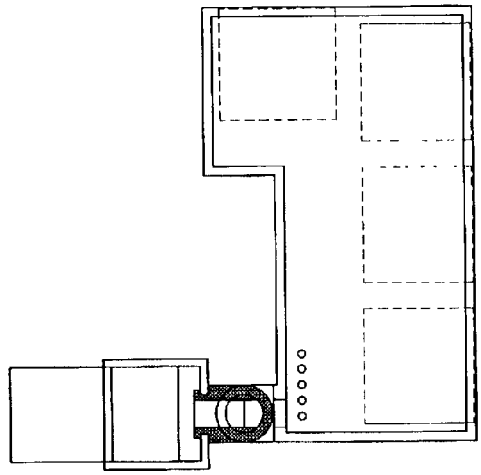
FIG. 11 is similar to FIG. 9 with the second connector positioned in a second position with is rotated through 90 degrees with respect to the first position.
Figure 10:
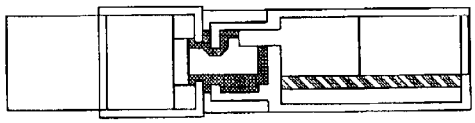
FIG. 10 is an end view taken from the second connector of FIG. 9.
Figure 12:
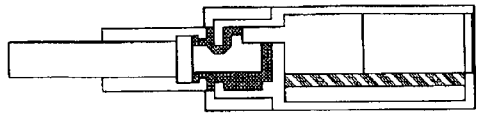
FIG. 12 is similar to FIG. 10 taken from the second connector of FIG. 11.

The ball joint 14 includes a supporting arm 15 on which a second connector 16 is rotationally mounted thereon by a pin shaft 156. The second connector 16 can be a typical USB connector, or an IEEE 1394 connector. The second connector 16 can be rotated centered on the pin shaft 156, as shown in FIGS. 5 and 6. By this arrangement, the second connector 16 can be positioned to any position in X, Y and Z directions. In addition, the ball joint 14 is further provided with a spring tab 141 (FIG. 6) so as to stablize the second connector 16 thereby preventing the obstruction of an adjacent port.

When the second connector 16 is not in use, the mating portion 17 can be received in the receiving slot 131. In addition, with the stopper 132 arranged therein, the second connector 16 will not in loose.

Referring to FIGS. 7 to 12, a connector hub assembly 2 in accordance with a second embodiment of the present invention is shown. The connector hub assembly 2 has a similar configuration to the connector hub assembly 1 with minor variation. The assembly 2 is provided with a hinge 24 on which a second connector 26 having a mating portion 27 is mounted thereto by a supporting arm 25 which has a hollow configuration. The second connector 26 is rotationally mounted thereto by a pin shaft 256. By this arrangement, the connector hub assembly 2 can be positioned in any position as required. Furthermore, the connector hub assembly 2 is defined a recessed portion 23 in which the second connector 26 can be received therein when the connector hub assembly 2 is not in use.

Figure 13:
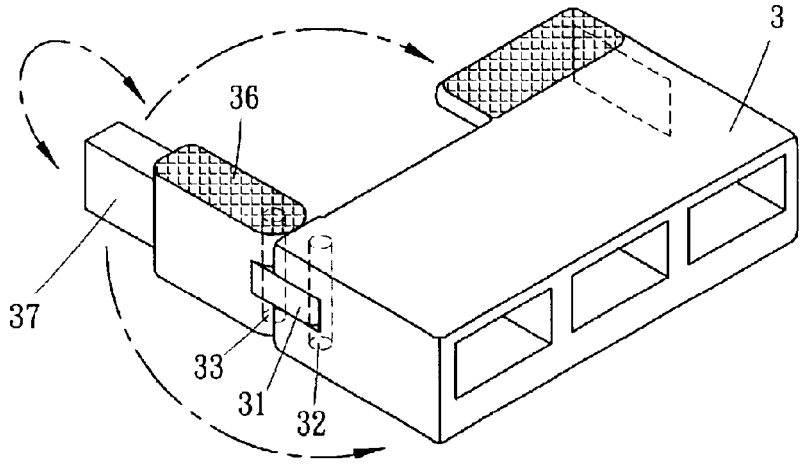
FIG. 13 is a perspective view of a connector hub assembly in accordance with a third embodiment of the present invention.

FIG. 13 discloses a connector hub assembly 3 in accordance with a third embodiment of the present invention. A second connector 36 having a mating portion 37 is moveably mounted to the connector hub assembly 3 by means of a link 31 pivotally mounted to the assembly 3 and the connector 36 by pin shafts 32 and 33 respectively. As result, the connector 36 can be moved to any desired position.

Figure 14:
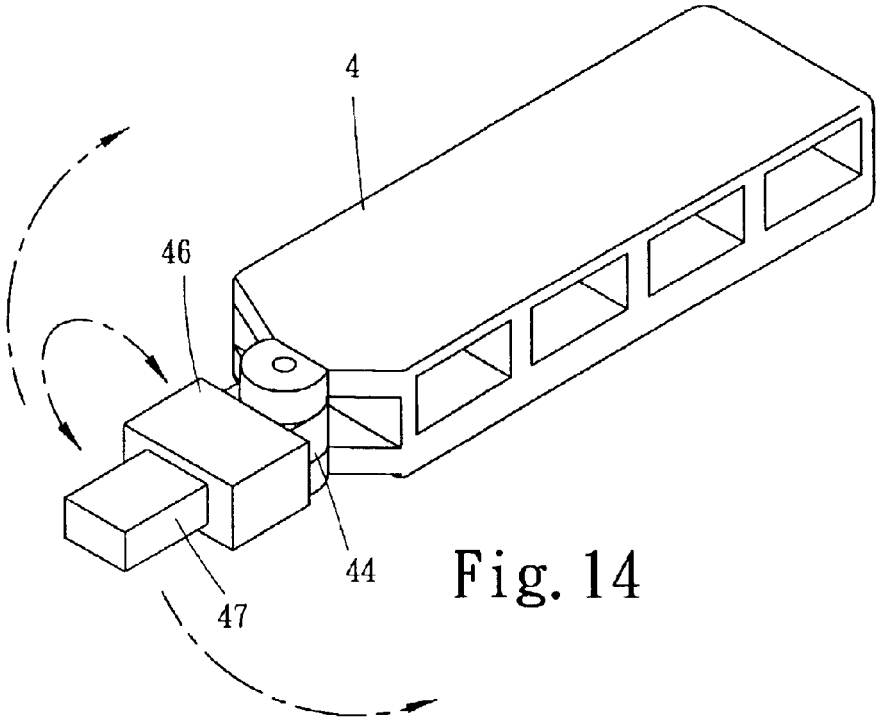
FIG. 14 is a perspective view of a connector hub assembly in accordance with a fourth embodiment of the present invention.

FIG. 14 discloses to a connector hub assembly 4 in accordance with a fourth embodiment of the present invention. The assembly 4 is similar to assembly 2 with a second connector 46 having a mating portion 47 arranged in an end of the assembly 4 by a hinge 44.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A connector hub assembly having universal joint, comprising:

a housing including at least a first connector having its mating portion accessible from a surface of the housing;

a joint device universally attached to the housing such that the housing is moveable along a first plane; and a second connector attached to the joint device, wherein the joint device includes a socket defined in a recessed portion of the housing and a ball joint swivelably received in the socket, wherein the joint device further includes a pin shaft located on an end of supporting arm of the ball joint, wherein the second connector is pivotally mounted on the pin shaft.

2. The connector hub assembly as recited in claim 1, wherein the first and second connectors are selected from a group consisting of a USB, IEEE 1394 connector, and PS2 connector.

3. The connector hub assembly as recited in claim 1, wherein the joint device is a link which is pivotally arranged on the first and second connector by means of pin shafts, respectively.

4. The connector hub assembly as recited in claim 1, wherein the joint device is a hinge arranged between the first and second connectors.

5. The connector hub assembly as recited in claim 4, wherein the hinge includes a hollowed shaft and the second connector is rotationally mounted therein by means of a pin shaft.

6. The connector hub assembly as recited in claim 4, wherein the joint device is arranged in a longitudinal end of the connector hub assembly.

7. A connector hub assembly having a universal joint, comprising:

a housing including at least a first connector having a mating portion accessible from a surface of the housing;

a joint device universally attached to the housing such that the housing is movable along a first plane; and a second connector attached to the joint device, wherein the joint device includes a socket defined in a recessed portion of the housing and a ball joint swivelably received in the socket, wherein the connector hub assembly further defines a receiving slot in which a mating portion of the second connector is received therein when not in use.

8. The connector hub assembly as recited in claim 7, wherein the receiving slot is provided with a stopper preventing the second connector from coming out of the receiving slot.

9. The connector hub assembly as recited in claim 7, wherein the first and second connectors are selected from a group consisting of a USB, IEEE 1394 connector, and PS2 connector.

10. The connector hub assembly as recited in claim 7, wherein the joint device is a link which is pivotally arranged on the first and second connector by means of pin shafts, respectively.

11. The connector hub assembly as recited in claim 7, wherein the joint device is a hinge arranged between the first and second connectors.

12. The connector hub assembly as recited in claim 11, wherein the hinge includes a hollowed shaft and the second connector is rotationally mounted therein by means of a pin shaft.

13. The connector hub assembly as recited in claim 11, wherein the joint device is arranged in a longitudinal end of the connector hub assembly.

* * * * *